United States Patent [19]

Robinson

[11] Patent Number: 4,834,195

[45] Date of Patent: May 30, 1989

[54] DRILL MAGAZINE

[75] Inventor: Allen C. Robinson, Maple Ridge, Canada

[73] Assignee: MacMillan Bloedel Limited

[21] Appl. No.: 110,847

[22] Filed: Oct. 21, 1987

[51] Int. Cl.[4] ..... E21B 19/14; E21B 19/20

[52] U.S. Cl. ..... 175/52; 175/85; 166/85; 211/70.4; 414/22.62; 414/746.8

[58] Field of Search ..... 175/52, 85; 166/77.5, 166/85; 211/70.4, 60.1, 69; 414/745, 22; 81/57.15, 57.16, 57.19, 57.2, 57.21

[56] References Cited

U.S. PATENT DOCUMENTS

| | | | |
|---|---|---|---|
| 3,552,506 | 1/1971 | Mayer | 414/22 X |
| 3,966,053 | 6/1976 | Loftis | 211/70.4 |
| 3,985,189 | 10/1976 | Jahnke et al. | 175/52 |
| 4,445,579 | 5/1984 | Bello | 175/52 |
| 4,449,592 | 5/1984 | Mayer | 175/52 |
| 4,455,116 | 6/1984 | Lindstedt et al. | 211/70.4 X |
| 4,632,618 | 12/1986 | Issakainen | 414/745 X |

FOREIGN PATENT DOCUMENTS

| | | |
|---|---|---|
| 944345 | 3/1974 | Canada . |
| 1018147 | 9/1977 | Canada . |
| 1025844 | 2/1978 | Canada . |
| 1050526 | 3/1979 | Canada . |

*Primary Examiner*—Bruce M. Kisliuk

[57] ABSTRACT

An improved drill rod magazine for storing and moving them sequentially into a dispensing position is comprised of a pair of spaced arms each with an open jaw in which the drill rods are positioned in parellel, side by side relationship. The arms are moveable from a storing position into at least two dispensing positions, in a first of which one of the rods in the jaws is aligned with the hammer of the drilling machine and in the second of which another rod (the adjacent rod) is aligned with the hammer. Each of the jaws is provided with a clamp to clamp the rods contained therein to prevent rotation of each rod for threading of the hammer into an adjacent coupling on the rod. The rod is released for rotation while retaining same within the jaws so that the rod coupled to the hammer may be rotated and advanced by the hammer to thread same into an aligned coupling, after which the arms are retracted to their storage position. For uncoupling the procedure is reversed.

6 Claims, 2 Drawing Sheets

DRILL MAGAZINE

The present invention relates to a drill rod magazine, more specifically the invention relates to a simplified drill rod magazine delivering drill rods to operative position permitting coupling and uncoupling of the drill rods.

BACKGROUND OF THE PRESENT INVENTION

There are a variety of different drill rod magazines for delivering drill rods to a drilling position. For example, Canadian Pat. No. 944,345 issued Mar. 26, 1974 to Campbell discloses a pipe handling apparatus including a storage rack and a slide to transport the pipes or rods between the rack and the drilling position. The two arms of the rack each have clots into which the vertical pipes are positioned in side by side relationship. These arms are moveable from vertical position wherein they receive the pipes from the derrick to a horizontal storage position. Suitable stops are provided at the mouths of the slots to prevent the rods from falling out.

Canadian Pat. Nos. 1,018,147 and 1,025,844 issued Sept. 27, 1977 and Feb. 7, 1978 to Schwartz et al and Canadian Pat. No. 1,050,526 issued Mar. 13, 1979 to Jahnke et al, all disclose drill magazines of the cylinder type, i.e. similar to the rotating cylinder of a pistol. Means are provided to prevent rotation of the rods by providing specific flattened sections on the rods and a cooperating wrench like means in the magazine. These devices are relatively complicated and expensive to produce and require extra machining and weakening of the drill rods.

In many drilling operations, for example, when constructing a road or the like through rocky, mountainous terrain, the depth of drilling normally will never exceed 2 or 3 conventional drill rod lengths. In these operations the rods are manually positioned when being added or subtracted from the drill string.

BRIEF DESCRIPTION OF THE PRESENT INVENTION

It is an objective of the present invention to provide a simplified drill magazine for handling several drill rods and moving them sequentially into operative position.

Broadly the present invention relates to a drill rod magazine comprising a mast, a main arm and an auxiliary arm spaced along said mast, means for interconnecting said arms for simultaneous movement between a storage position and at least one dispensing position, a driver moveable and rotatable about an axis along said mast in an axial direction, a jaw on each said arm, said jaws adapted to accommodate at least one drill rod with its longitudinal axis substantially parallel to said axis of movement of said driver, clamping means in said jaw of at least said main arm adapted to clamp said at least one drill rod and prevent movement thereof, detent means projecting from each of said jaws to retain said at least one drill rod within said jaws while permitting axial movement of and rotation of said at least one rod in said jaws when said clamp means is released and said arms are in said dispensing position, means for moving said arms between a storage position and said at least one dispensing position and means for activating and deactivating said clamping means, Broadly the present invention also relates to a drill rod magazine comprising a pair of spaced arms each having a jaw or slot therein adapted to receive drill rods in axially aligned side by side relationship, one of said jaws embracing each of said drill rods adjacent an end of each of said drill rods having a coupling thereon and the other said arms being spaced towards the opposite end of said drill rods, said one arm being adjacent to a hammer, each said arm having detent means to retain said rods in said jaws while permitting rotation thereof about their longitudinal axis and with clamping means adapted when activated to prevent rotation of said rods, said clamping means in said one arm clamping said couplings to prevent rotation of said couplings when said clampings means is in clamp position, said pair of arms being movable from a storage position to a first dispensing position wherein a drill rod closest to the mouths of said jaws is in axial alignment with said hammer or a second dispensing position wherein the adjacent rod to said one closest said mouth is in axial alignment with the longitudinal axis of said hammer.

Preferably said arm will be mounted for a pivotal movement between said storage and said first and second dispensing positions and will be interconnected by shaft means fixed to each arm so that the two arms pivot simultaneously when moving between said dispensing and said storage positions.

Normally means will be provided for preventing axial movement of said rods in a direction from said one arm toward said other arm when said rods are in positions other than said dispensing position.

In some cases it may be necessary to prevent axial movement of said rods in a direction away from said other arm towards said first arm and a lip may be provided on the side of the first arm remote from said other arm in position to engage said coupling and prevent axial movement of said rod towards said hammer.

BRIEF DESCRIPTION OF PRESENT INVENTION

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
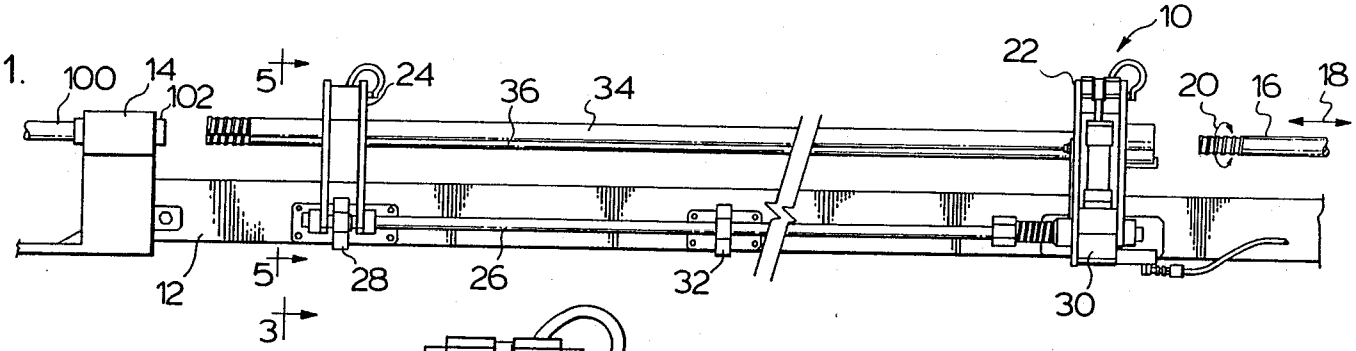
FIG. 1 is a side elevation schematically illustrating the present invention positioned in relation to the hammer and a clamp.

As shown in FIG. 1 a drill magazine generally indicated at 10 is mounted on the mast 12 of the drilling rig which at one end is provided with a bearing and releasable clamping means 14 and at its opposite end with the rotatable driving head, sometimes called the hammer 16. The hammer 16 is moveable axially as indicated by the arrow 18 and is rotatable in both directions about its longitudinal axis as is indicated by the arrow 20. This driving head schematically indicated at 16 is moveable on a carriage along the mast 12 between the bearing and clamping means 14 and its retracted position as illustrated.

The magazine structure 10 is composed of a main arm 22 positioned adjacent the driver 16 and an auxiliary arm 24 spaced from the main arm 22 and located adjacent the clamping means 14 at the opposite end of the mast 12. The arms 22 and 24 are each pivotably mounted on the mast 12, in the illustrated arrangement on a shaft 26 which is mounted on bearings indicated at 28 and 30 on mast 12 adjacent the main and auxiliary arms 22 and 24 respectively.

The shaft 26 couples the two arms 22 and 24 together so that they pivot simultaneously with the shaft 26 when it is rotated about its axis. In the illustrated arrangement the shaft 26 has a mid bearing 32 mounted on the mast 12 for further support.

In the illustrated arrangement the magazine can accommodate two drill rods 34 and 36 but it could be modified to accommodate fewer or more rods.

Figure 2:
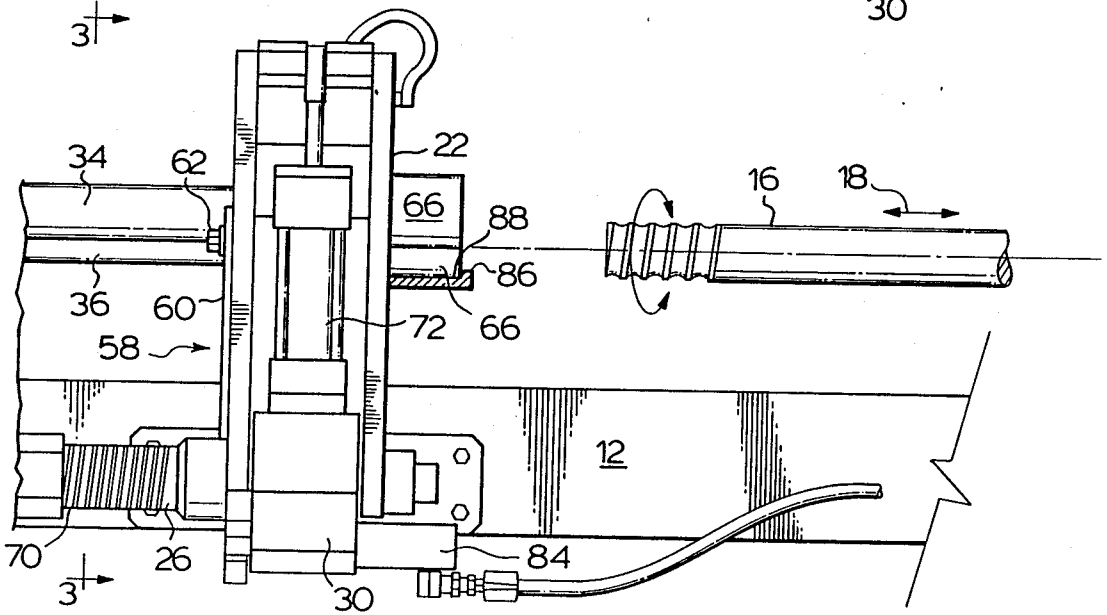
FIG. 2 is an enlarged view of the main arm of the magazine of the present invention located adjacent to the hammer.
Figure 3:
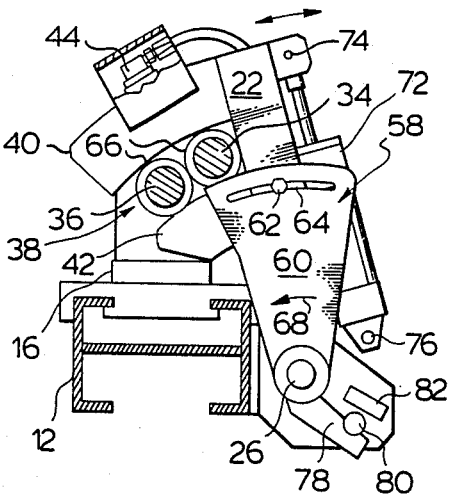
FIG. 3 is a view along line 3—3 of FIG. 2 illustrating the main arm pivoted to dispensing position.
Figure 4:
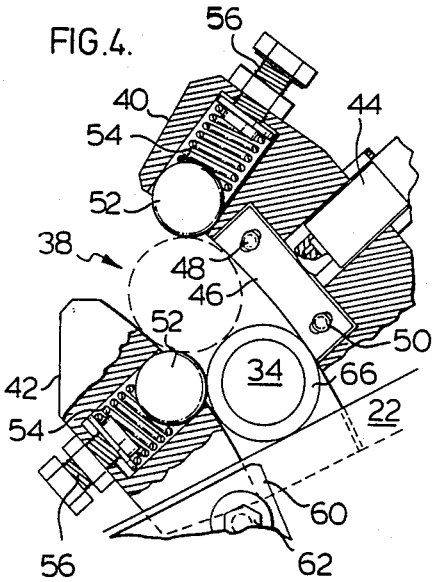
FIG. 4 is a section through the main arm shown in FIG. 3 to illustrate the clamping and detent means provided in the jaw of the arm.

Referring to FIGS. 2, 3 and 4 the main arm 22 has an open jaw of slot as indicated at 38 and defined by an upper jaw member 40 and a lower jaw member 42. As shown in FIG. 4 the upper jaw member 40 is provided with a hydraulically operated clamping mechanism 44 having a clamping plate 46 mounted on pins 48 and 50 which permit limited relative travel of the plate 46 toward the lower jaw 40. This permits the clamp to operate if there is only one drill rod within the jaw such as the drill rod 34 as shown in FIG. 4 (obviously the clamps may be activated by any suitable driving means). Only a single clamping mechanism has been shown for each of the arms 22 and 24, however, a separate clamping mechanism may be used for each rod position to individually clamp each rod. Such an arrangement of individual clamps for each rod is preferred particularly for arm 24.

Ball detents 52 are provided in the upper and lower jaw members 40 and 42 respectively. Each of these balls 52 are similarly mounted on a spring 54 urging the balls from the face of the jaw member on which it is mounted toward the opposing jaw member. The compression of the springs 54 may be adjusted by a suitable adjusting means as indicated at 56.

The balls 52 hold the rods 34 and 36 in position while permitting same to rotate when the clamping plate 46 is in retracted position, i.e. non-clamping position and are displaceable by compressing the springs 54 to release the rods as will be described in more detail below.

Figure 5:
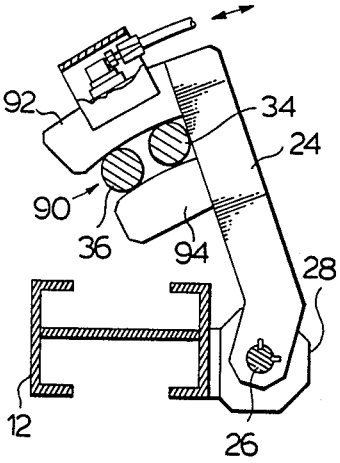
FIG. 5 is a view similar to FIG. 3 but taken along the lines 5—5 of FIG. 1 and illustrating the auxiliary arm of the magazine.

The main arm 22 is also provided with a retaining device 58 which prevents axial movement of the drill rods 34 and 36 towards the clamp 14 unless the rods are in their dispensing position, i.e. the position of the rod 36 in FIGS. 3 and 5.

The retaining device 58 is composed of a plate 60 pivotably mounted on the shaft 26 and pinned to the arm 22 by a pin 62 passing through slot 64 in the plate 60 to permit relative movement of the arm 22 and plate 60. It will be noted that the plate 60 extends beyond the upper surface of the lower jaw 42 in a position to interfere with axial movement of the couplings 66, without interfering with the rods 34 and 36. The plate 60 is biased in the direction of the arrow 68 by a torsion spring 70 (FIG. 2) encircling the shaft 26.

The arm 22 and the arm 24 are each fixed to the shaft 26 and are movable between the various positions by pivoting the shaft 26. This pivotal movement is obtained by means of a piston and cylinder generally indicated at 72, the piston of which is pivotally connected at one end 74 to the arm 22 and at the other end to the bearing housing for bearing 30 which is fixed to the mast 12. Extension of the pisotn and cylinder 72 causes the arm 22 to pivot and rotate shaft 26 and thereby auxiliary arm 24.

The arms are stopped in selected operative positions with the drill rod 34 or 36 in proper dispensing position in axial alignment with the driver or hammer 16 by suitable fixed and retractable stops.

As most clearly shown in FIG. 3 the arm 22 has an extension 78 rigidly secured thereto and adapted to cooperate either with the retractable stop pin 80 or the fixed stop 82 depending on whether or not the pin 80 is in the extended or retracted position. The fixed stop 82 is in fixed position relative to the frame 12. When the pin 80 is extended and is contacted by extension 78 as illustrated in FIG. 3 magazine 10 is in a first dispensing position, i.e. the drill rod 36 is in dispensing position with its longitudinal axis aligned with the axis of the driver 16. When the pin 80 is retracted the arm 22 is permitted to move farther until the extension 78 contacts the fixed stop 82 and the magazine 10 is in a second dispensing position with the drill rod 34 in dispensing position.

In the second position wherein the extension 78 contacts the stop 82, the drill rod 34 is in essentially the same physical position as the drill rod 36 when the magazine 10 is in the first dispensing position where the extension 78 engages pin 80 as illustrated in FIG. 3, i.e. the axis of the rod 34 is aligned with the longitudinal axis of the drill 16 and the rod 34 is in operative dispensing position.

The pin 80 may be retracted by any suitable means, in the illustrated arrangement a pneumatic piston and cylinder arrangement 84 has been provided (FIG. 2).

In some cases where drilling upward is contemplated provision must be provided to prevent the drill rods from sliding rearwardly when not clamped. To prevent this rearward movement, i.e. a movement towards the driving head 16 a suitable lip 86 is provided at the end of a flange 88 projecting rearwardly from the arm 22. This lip 86 interferes with rearward movement of the rod by engagement of the end edges of the couplings 66 to prevent such rearward movement. Lip 86 is of insufficient height to interfere with the axial movement of the driving head 16 into engagement with the couplings 66.

Figure 6:
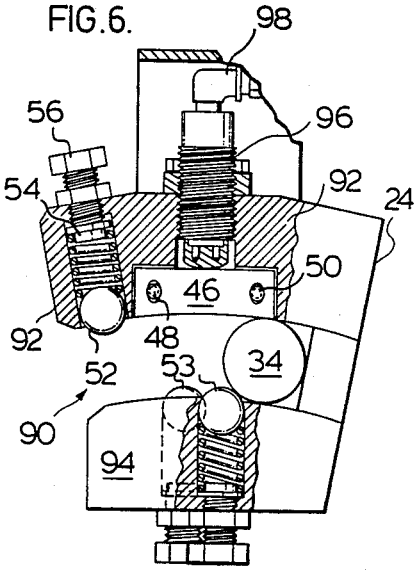
FIG. 6 is a view similar to FIG. 4 but illustrating the clamping and detent means of the auxiliary arm.

Referring to FIGS. 5 and 6, arm 24 is also provided with an open jaw or slot 90 essentially equivalent to the open jaw or slot 38. The slot 90 is formed by an upper jaw member 92 and a lower jaw member 94.

The upper jaw member 92 of the arm 24 is provided with a single detent 52 equivalent to the detent 52 of the jaw member 40 with the corresponding springs and adjusting mechanisms 54 and 56. However, the bottom jaw member 94 has two detents 53 essentially equivalent to detent 52 in the main arm 24 but smaller. The function of the detents 52 and 53 are to permit rotation of the rods 34 and 36 each around its respective longitudinal axis while holding the rods between the jaw members 40, 42, 92 and 94 of the respective arms 22 and 24.

A clamping mechanism 96 which is connected to a source of fluid pressure via line 98 is essentially the same as the clamping mechanism 44 in arm 22. Preferably individual clamping mechanisms 96 will be provided for each rod 34 and 36 and the plate 46 for each will be mounted and sized to contact only its respective rod.

The jaw member 94 is provided with two ball detents 53 spaced as indicated in position to contact the peripheries of the rods 34 and 36 and align them. The use of two spaced ball detents 53 in the jaw member 94 is to accommodate the smaller diameter of the rods themselves as compared with the couplings 66 which encircle the rods. Comparing FIGS. 4 and 6 it will be apparent the spacing between the jaw members 40 and 42 or width of slot 38 is larger than the spacing between the jaw members 92 and 94 or width of slot 90 and the depth of the slot 90 is less than that of the slot 38 because of the differences in outside diameters of the rods and the couplings.

In operation two rods 34 and 36 are mounted in side by side position with their longitudinal axis substantially parallel and with the couplings 66 at one end of the rods received and held in the slot 38 between the jaw members 40 and 42 of arm 22 by detents 53. The rods are received and held in the slot 90 between the jaw members 92 and 94 of the arm 24 by the detents 52 and 53. These detents (balls) 52 and 53 fix the position of the longitudinal axis of the rods 34 and 36 relative to the arms 22 and 24 and thus relative to the driver 16 so that longitudinal axes of the rods may be selectively aligned with that of the driver 16, i.e. the direction of axial movement of the driver 16 towards the fixed clamp 14.

In operation the arms 22 and 24 are withdrawn to the storage position while the first rod 100 (FIG. 1) with a suitable coupling 102 connected to the drill head driver 16 is driven by the driver 16. When the rod 100 is fully driven the coupling 102 thereof is gripped by the guiding and clamping means 14 on the end of the mast 12 and the driver 16 is decoupled from the coupling 102. The driver 16 is then withdrawn to the position shown in FIG. 1.

At this point two rods 34 and 36 are held in the magazine 10 and the arms 22 and 24 are in the storage position, i.e. the piston and cylinder arrangement 72 is fully retracted so that the arms 22 and 24 are completely clear of the path of travel of the hammer or driver 16.

To dispense the first rod 36 the pin 80 is first extended and then the piston and cylinder 72 is extended to drive the stop 78 against a pin 80 and thereby position the longitudinal axis of the rod 36 in alignment with the longitudinal axis of the driver or hammer 16.

The clamp 46 in the main arm 22 is activated to clamp the couplings 66 to prevent rotation thereof at the same time the clamping plate 46 and the arm 24 may also be activated to hold the rods 34 and 36 in position between the jaw members 92 and 94 and prevent rotation thereof. If the couplings are fixed to the rods simply preventing rotation of the rods will suffice and the clamps in one or both jaws 22 and/or 24 may be provided.

The driver 16 is then advanced into coupling 66 on the rod 36 and is rotated to thread itself into the coupling.

The clamping plate 46 in both arms 22 and 24 are then released to permit rotation of the rod 36 and its coupling 66 by the driver 16. The driver 16 is threaded to the coupling 66 on the rod 36 and is advanced axially to moe the end of the rod 36 into coupling 102 and the rod 36 is threaded into the coupling 102 of the rod 100, i.e. as above indicated the axis of the rod 36 and of the driver 16 are aligned as is the axis of the rod 100. This axial movement of the rod 36 is permitted since movement of the arm 22 into first dispensing position wherein the rod 36 is axially aligned with the driver 16 moves the rod 36 and coupling 66 beyond the plate 60 which is prevented from moving with the arm 22 by engagement of the leading edge thereof with the side of mast 12.

After the rod 36 has been threaded into the coupling 102 the piston and cylinder 72 is activated thereby to moe the arm 22 and through the shaft 26 the arm 24 back to the storage position. The detents 52 are depressed as the arms are retracted to permit the rod 36 to escape from the jaws.

The drilling operation is carried on with rod 36 as a part of the drill string until the rod 36 reaches the position of the rod 100 in FIG. 1 and the coupling 66 thereon is received within the clamping means 14. Clamping means 14 is activated to hold the coupling 66 and the rod 36, the driver 16 is decoupled and retracted to the position in FIG. 1. Next the piston and cylinder 72 are reactivated but the pin 80 is not advanced and therefore remains retracted so that the extension stop 78 now moves into engagement with the stop 82. This position of the arms 22 and 24 aligns the longitudinal axis of the rod 34 held between detents 52 and 53 and the back wall of the slots 38 and 90 in axial alignment with the longitudinal axis of the driver 16. The procedure followed with respect to the rod 36 is now followed with respect to the rod 34 and when it is coupled to the coupling 66 of the rod 36 the arms 22 and 24 are retracted by again withdrawing the piston and cylinder 72 with the rod 34 passing out of the slots 38 and 90 by depressing the ball detents 52 and 53.

It will be apparent that the ball detents 52 and 53 are free to rotate in their sockets and thus the rods 34 and 36 may be rotated and axially advanced during the threading operation when coupling the rods to the coupling clamped in the clamping means 14. When the arms 22 and 24 are retracted the detents 52 and 53 are simply depressed to free the rods 34 and 36 from the slots 38 and 90.

In the illustrated arrangement it was assumed that only a maximum of 3 rods are to be used with the rod 100 providing the first rod. If desired the slots may be deeper and adapted to accommodate more than two rods (there will be as many dispersing positions as rods to be dispensed).

When drilling is completed to the desired depth the procedure is reversed. In the case where rod 34 is driven the driver 16 is still coupled to the coupling 66 of the rod 34 and is retracted moving the coupling 66 on the rod 36 into the clamping means 14. The clamping means 14 is activated to clamp this coupling 66 and firmly hold same. The arms 22 and 24 are moved to their most forward (second dispensing) position, i.e. with extension stop 78 engaging the stop 82 so that the rod 34 is moved into position in the arm 22 and 24 and held via the detents 52 and 53. The rod 34 and coupling 66 are clamped in the arms 22 and 24 and the driver 16 turned to tighten the connection of driver 16 and rod 34. The rod 34 is then released and rotated so that it is dethreaded from the coupling 66 on the rod 36 and is retracted. The plate 60 as above indicated is clear so that it does not interfere with axial movement of the coupling 66.

With the rod 34 decoupled from the rod 36 clamping plates 46 in the arms 22 and 24 are activated to firmly hold rod 34 and coupling 66 and then the driver is manipulated to decouple its threaded connection with the coupling 66 on the rod 34. The magazine 10 is then retracted by the piston and cylinder arrangement 72 to move the arms 22 and 24 to their storage positions and the driver 16 then advanced, coupled to the coupling 66 on the end of the rod 36 and after the clamping means 14 is released the rod 36 is retracted to bring the coupling 102 into the clamping means 14. The above described procedure is repeated this time with the pin 80 extended so that the rod 36 is returned to the position illustrated in the drawings. Thereafter the driver 16 may be coupled to the coupling 102 and the rod 100 withdrawn.

Having described the preferred embodiments of the present invention modifications will be evident to those skilled in the art without departing from the spirit of the invention as defined in the appended claims.

I claim:

1. A drill rod magazine structure for a rock drilling device comprising a mast, a main arm and an auxiliary arm spaced along said mast, means for interconnecting said arms for simultaneous movement between a storage position and at least one dispensing position, a driver moveable along and rotatable about an axis of movement of said driver and extending longitudinally of said mast, jaws on each of said arms, said jaws being formed by spaced jaw members adapted to accommodate at least one drill rod therebetween with the longitudinal axis of said at least one drill rod substantially parallel to said axis of movement of said driver, a clamping mechanism on at least one of said jaws adapted to clamp said at least one drill rod and prevent movement thereof, detent means projecting (protecting) from said jaw members and biased to projected position to retain said at least one drill rod within said jaws while permitting axial movement of and rotation of said at least one rod in said jaws when said clamping mechanism is released, means for moving said arms between a storage position and said at least one dispensing position, said detent means being moveable from said projected position to permit said at least one drill rod to exit from said jaws and means for activating and deactivating said clamping mechanism.

2. A drill rod magazine as defined in claim 1 wherein said jaws are adapted to accommodate at least two said drill rods in side by side relationship with their longitudinal axes substantially parallel and wherein said arms are moveable into at least two dispensing positions.

3. A drill rod magazine as defined in claim 2 wherein said arms are pivotably mounted on one side of the mast for movement between said positions and are interconnected by a shaft fixed to each arm.

4. A drill rod magazine as defined in claim 3 further comprising plate means for preventing axial movement of each said rod in a direction from said main rod and toward said auxillary arm only when said rod is not in its dispensing position.

5. A drill rod magazine as defined in claim 1 wherein said clamping mechanism comprises a clamping plate on said main arm.

6. A drill rod magazine as defined in claim 1 wherein separate detent means are provided for each of said at least 2 drill rods.

* * * * *